US008424546B2

(12) United States Patent
Verma et al.

(10) Patent No.: US 8,424,546 B2
(45) Date of Patent: Apr. 23, 2013

(54) SUMP ASSEMBLY FOR A DISHWASHER, AND ASSOCIATED METHOD

(75) Inventors: Ashish A. Verma, Winterville, NC (US); Randall S. Mabery, Winterville, NC (US); Jeffrey E. Nelson, Kinston, NC (US); Virgil J. Francisco, Ayden, NC (US); Mark D. Montgomery, Greenville, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 942 days.

(21) Appl. No.: 12/173,342

(22) Filed: Jul. 15, 2008

(65) Prior Publication Data

US 2010/0012159 A1 Jan. 21, 2010

(51) Int. Cl.

| | |
|---|---|
| ***B08B 3/00*** | (2006.01) |
| ***B08B 3/04*** | (2006.01) |
| ***B08B 3/12*** | (2006.01) |
| ***B08B 6/00*** | (2006.01) |

(52) U.S. Cl.

USPC ..... 134/186; 134/56 D; 134/57 D; 134/58 D; 134/104.2

(58) Field of Classification Search ..... 134/186, 134/104.2, 56 D, 57 D, 58 D See application file for complete search history.

(56) References Cited

U.S. PATENT DOCUMENTS

| | | | | |
|---|---|---|---|---|
| 2003/0019510 | A1* | 1/2003 | Hegeman et al. | 134/18 |
| 2004/0079400 | A1* | 4/2004 | Young | 134/57 D |
| 2006/0021637 | A1* | 2/2006 | Kang | 134/56 D |
| 2006/0042657 | A1* | 3/2006 | Welch | 134/10 |
| 2006/0054196 | A1 | 3/2006 | Yoon et al. | |
| 2006/0054199 | A1 | 3/2006 | Yoon et al. | |
| 2006/0054200 | A1 | 3/2006 | Min et al. | |
| 2006/0054201 | A1 | 3/2006 | Yoon et al. | |
| 2006/0118143 | A1 | 6/2006 | Jeong et al. | |
| 2006/0118145 | A1 | 6/2006 | Woo Woo | |
| 2006/0174923 | A1* | 8/2006 | Hedstrom et al. | 134/104.2 |
| 2006/0219272 | A1* | 10/2006 | Lee et al. | 134/56 D |
| 2006/0249184 | A1 | 11/2006 | Chung et al. | |

(Continued)

FOREIGN PATENT DOCUMENTS

| | | |
|---|---|---|
| CN | 1913822 | 2/2007 |
| CN | 101164489 | 4/2008 |

(Continued)

OTHER PUBLICATIONS

International Search Report and Written Opinion for International Application No. PCT/US2009/050642 completed May 26, 2010.

(Continued)

*Primary Examiner* — Michael Barr
*Assistant Examiner* — Charles W Kling
(74) *Attorney, Agent, or Firm* — Alston & Bird LLP

(57) ABSTRACT

A sump assembly for a dishwasher and associated method are provided. The sump assembly comprises an integrally-formed sump member defining a circulation pump volute receptacle and a drain pump volute receptacle. The circulation pump volute receptacle and the drain pump volute receptacle are adapted to receive respective pump and motor assemblies. Each of the volute receptacles is configured to receive the respective pump and motor assembly along a respective horizontal axis defined thereby. The drain pump volute receptacle includes a washing fluid input in direct communication with the circulation pump volute receptacle for receiving the washing fluid therefrom.

30 Claims, 9 Drawing Sheets

U.S. PATENT DOCUMENTS

| | | | | |
|---|---|---|---|---|
| 2007/0251555 | A1 | 11/2007 | Choi et al. | |
| 2007/0261725 | A1 | 11/2007 | Choi et al. | |
| 2007/0272283 | A1 | 11/2007 | Choi et al. | |
| 2008/0011340 | A1 | 1/2008 | Kim | |
| 2008/0072934 | A1 | 3/2008 | Pyo et al. | |
| 2008/0173338 | A1 * | 7/2008 | Kim et al. | 134/186 |

FOREIGN PATENT DOCUMENTS

| | | | | |
|---|---|---|---|---|
| EP | 1 770 713 | A2 | | 4/2007 |
| FR | 2505642 | A | | 11/1982 |
| GB | 2 049 406 | A | | 12/1980 |
| GB | 2049406 | | | 12/1980 |
| GB | 2049406 | A | * | 12/1980 |
| GB | 2 305 810 | A | | 4/1997 |
| KR | 10 2006 0063389 | A | | 6/2006 |
| RU | 2197789 | | | 1/2003 |
| WO | WO-2006/062305 | | | 6/2006 |
| WO | WO 2006/062305 | A1 | | 6/2006 |

OTHER PUBLICATIONS

Office Action for Korean Application No. 10-2011-7003414, dated Oct. 8, 2012.

Office Action for Russian Application No. 2011101313/12(001636) dated Nov. 29, 2011.

Office Action for Chinese Application No. 200980132701.8, dated Aug. 31, 2012.

Office Action from Korean Patent Application No. 10-2011-7003414, mailed Oct. 8, 2012.

* cited by examiner

SUMP ASSEMBLY FOR A DISHWASHER, AND ASSOCIATED METHOD

BACKGROUND OF THE INVENTION

1. Field of the Invention

Embodiments of the present invention relate to washing appliances and, more particularly, to a sump assembly for a washing appliance, and an apparatus and method associated therewith.

2. Description of Related Art

A dishwasher typically includes a tub for receiving dishware or other items to be washed and a gravity-fed sump assembly for receiving a washing fluid used to wash the dishware. Such a dishwasher usually includes spray arms, mounted within the tub, in communication with a circulation pump for spraying the washing fluid under pressure onto the dishware or other items. Particles dislodged from the dishware or other items are carried along with the washing fluid toward the sump assembly, which is generally disposed about the lower portion of the tub. Typically, a filtering system may provide for the screening and/or filtering of the particles so that the re-circulated washing fluid supplied by the circulation pump to the spray arms is substantially devoid of particles. Further, the sump assembly may also be in communication with a separate drain pump for removing the washing fluid from the dishwasher via a house drain, wherein the drain pump is typically connected to the sump assembly by a rubber hose and associated clamping members.

As dishwashing machines continue to improve in washing effectiveness, operational quietness, and energy efficiency, consumers may increasingly use dishwashers for a greater percentage of their total dishwashing needs. The effectiveness of a dishwashing machine is often directly related to the conditions associated with the washing fluid used thereby. In this regard, the configuration of the sump assembly, as well as the sump assembly's interaction with other dishwasher components, may often have a significant effect on the condition and flow of the washing fluid within the dishwasher, and accordingly, may affect the efficiency of the dishwashing operation.

Generally, the flow of washing fluid within a sump assembly may be rather turbulent, and the surface features and/or contours of the sump assembly may undesirably produce large eddy formations. Further, the turbulent kinetic energy of the washing fluid can create small pressure perturbations (sound waves) and secondary vortex formations. The turbulent kinetic energy of the washing fluid within the sump assembly may also undesirably lead to rapid bubble formations. These undesirable flow problems may generally limit the efficiency and effectiveness of the dishwashing machine.

In addition, a sump assembly is generally comprised of numerous components, which may be costly to produce and assemble. Servicing or repairing such a sump assembly may be difficult due to the increased number of components and because various tools may be required for assembling and disassembling the sump assembly, which often requires a costly visit by a repairman to service the dishwasher. Another problem associated with a typical sump assembly having numerous components is the lack of commonality amongst sump assembly platforms. Furthermore, the numerous components of the sump assembly may lead to additional problems such as washing fluid leaks at the interacting portions of the sump assembly components.

Accordingly, there exists a need for a sump assembly and associated method for capable of providing improved flow and conditions of the washing fluid therein, while also lessening the number of sump assembly components and reducing the likelihood of washing fluid leaks originating at the sump assembly.

BRIEF SUMMARY OF THE INVENTION

The above and other needs are met by the present invention which, according to one aspect, provides a sump assembly for a dishwasher. The sump assembly comprises an integrally-formed sump member defining a circulation pump volute receptacle and a drain pump volute receptacle. The circulation pump volute receptacle is adapted to receive a circulation pump and motor assembly, and the drain pump volute receptacle is adapted to receive a drain pump and motor assembly. Further, the circulation pump volute receptacle and the drain pump volute receptacles are configured to receive their respective pumps and motor assemblies along a respective horizontal axis defined by the receptacles. The drain pump volute receptacle also has a washing fluid input that is in direct communication with the circulation pump volute receptacle for receiving the washing fluid from the circulation pump.

Another aspect of the present invention provides a dishwasher comprised of a tub portion and a sump assembly. The tub portion is adapted to contain washing fluid, which is circulated about the dishware located within the tub portion. The sump assembly is disposed about a lower end of the tub portion, and receives the washing fluid contained within the tub portion of the dishwashing machine. The sump assembly comprises an integrally-formed sump member defining a circulation pump volute receptacle and a drain pump volute receptacle. The circulation pump volute receptacle is adapted to receive a circulation pump and motor assembly, and the drain pump volute receptacle is adapted to receive a drain pump and motor assembly. Each of the volute receptacles are further configured to receive their respective pump and motor assembly along a respective horizontal axis defined by the receptacles. The drain pump volute receptacle has a washing fluid input that is in direct communication with the circulation pump volute receptacle for receiving the washing fluid therefrom.

Yet another aspect of the present invention provides a method of forming a sump assembly for a dishwasher, comprising of integrally-forming a sump member defining a circulation pump volute receptacle and a drain pump volute receptacle. The circulation pump volute receptacle is adapted to receive a circulation pump and motor assembly, and the drain pump volute receptacle is adapted to receive a drain pump and motor assembly. Each of the volute receptacles are further configured to receive their respective pump and motor assembly along a respective horizontal axis defined by the receptacles. The method further comprises integrally-forming a sump member such that a washing fluid input to the drain pump volute receptacle is in direct communication with the circulation pump volute receptacle so as to receive the washing fluid therefrom.

Embodiments of the present invention thus provide advantages as otherwise detailed herein.

BRIEF DESCRIPTION OF THE SEVERAL VIEWS OF THE DRAWINGS

Figure 1:
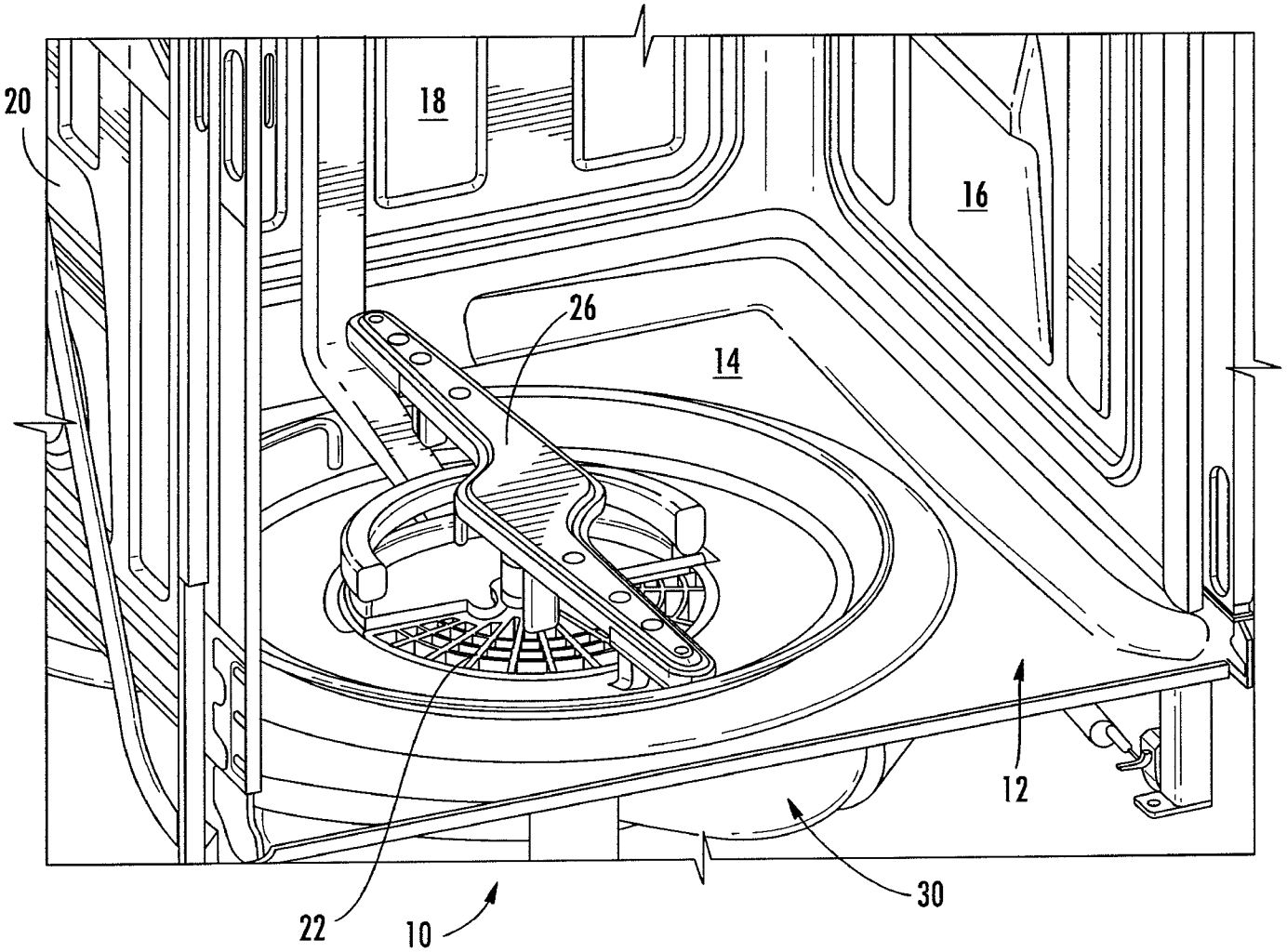
Figure 2A:
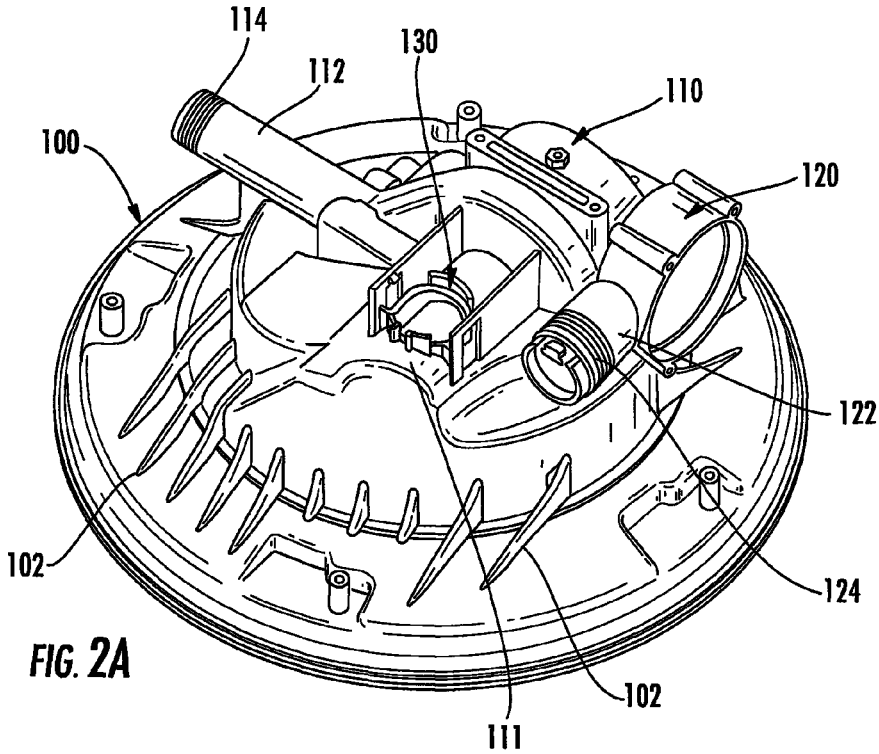
Figure 2B:
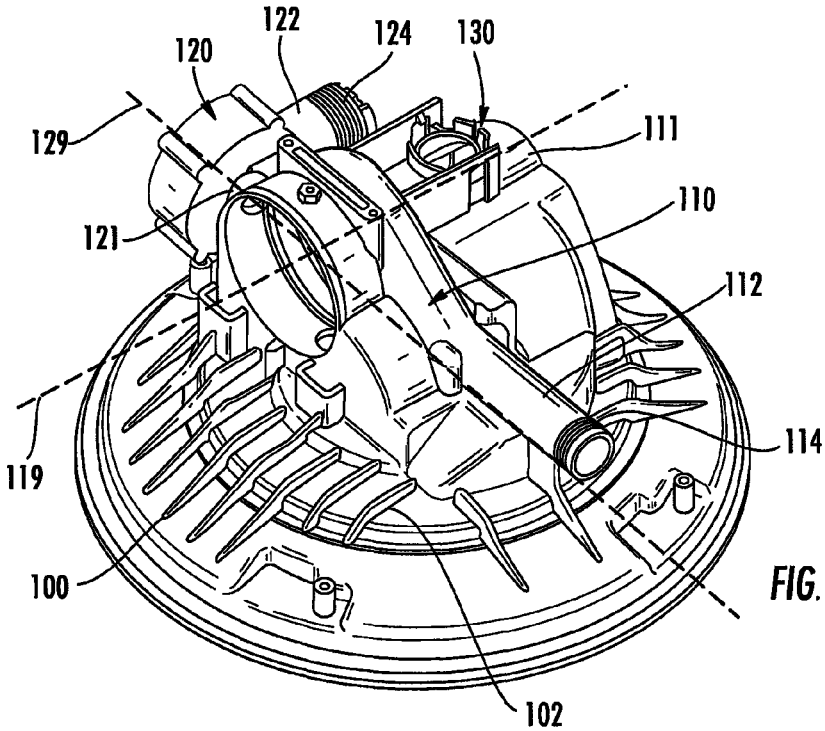
Figure 3A:
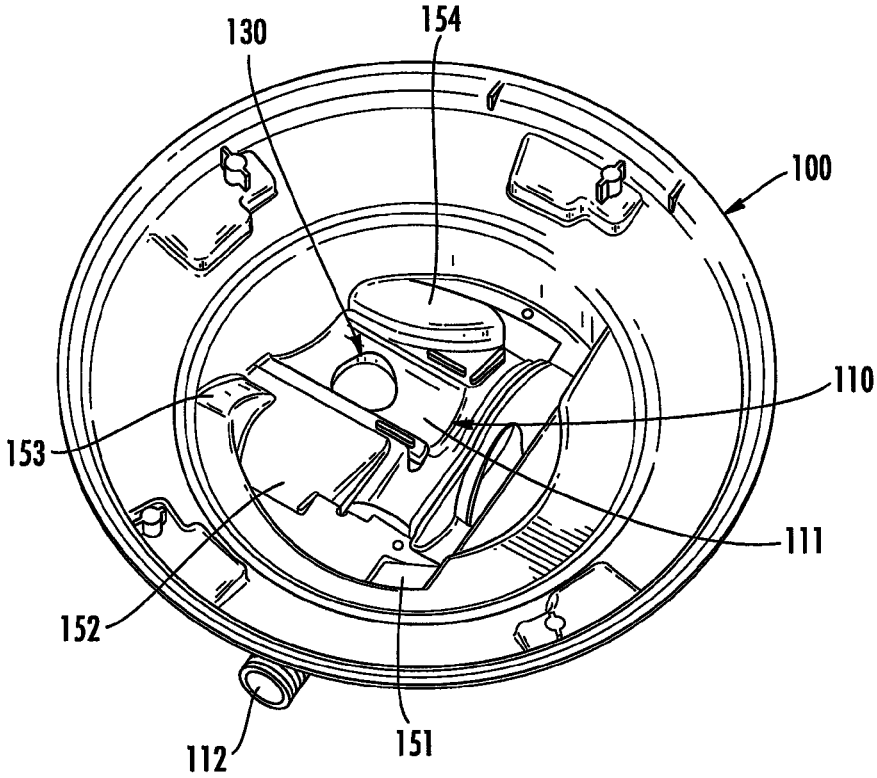
Figure 3B:
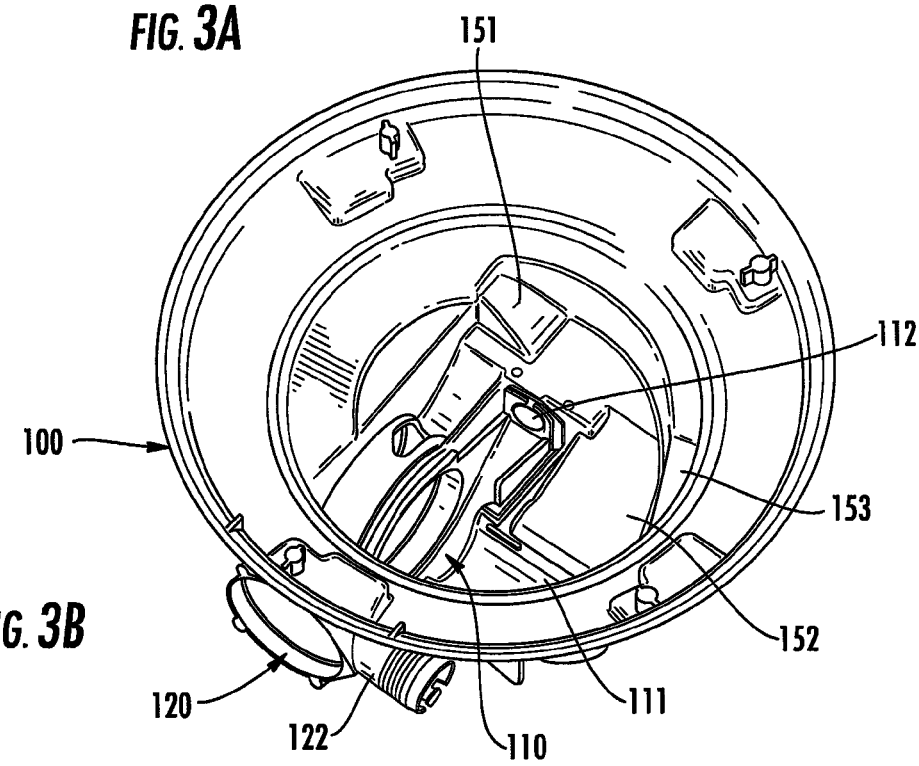
Figure 4A:
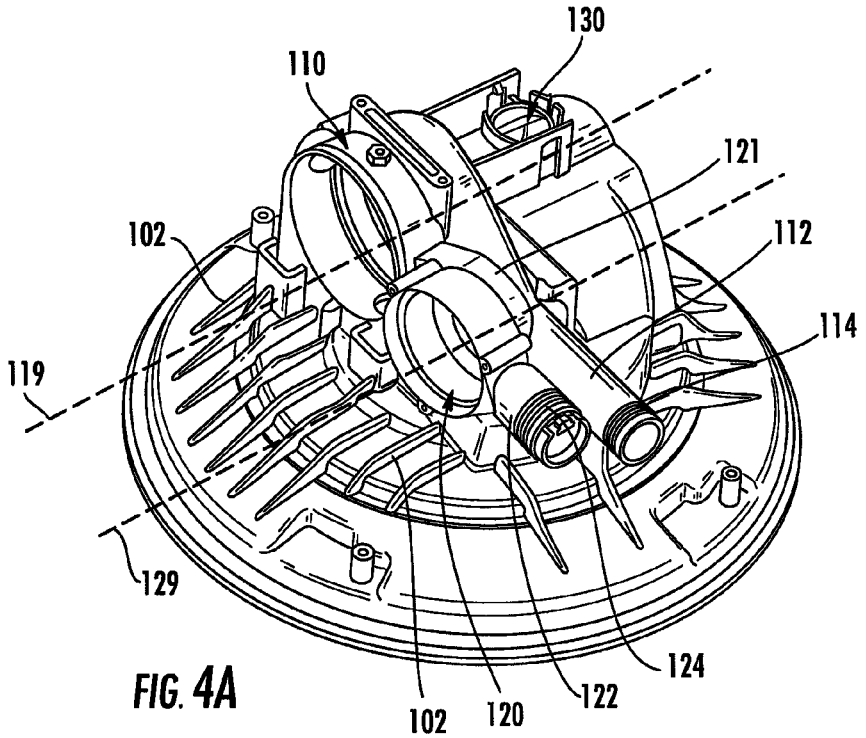
Figure 4B:
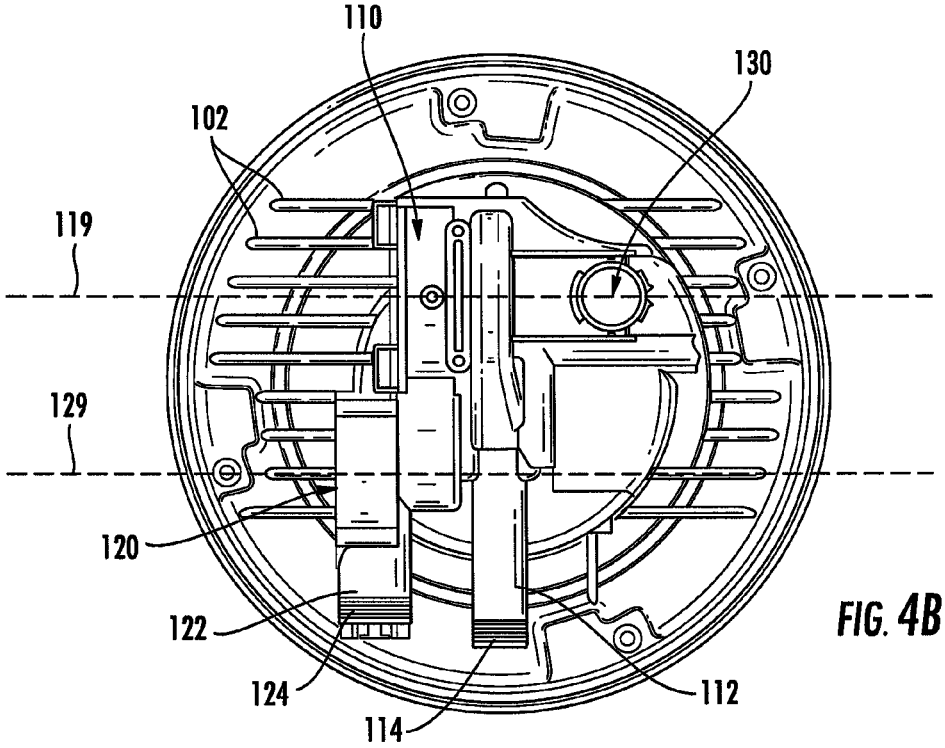
Figure 5A:
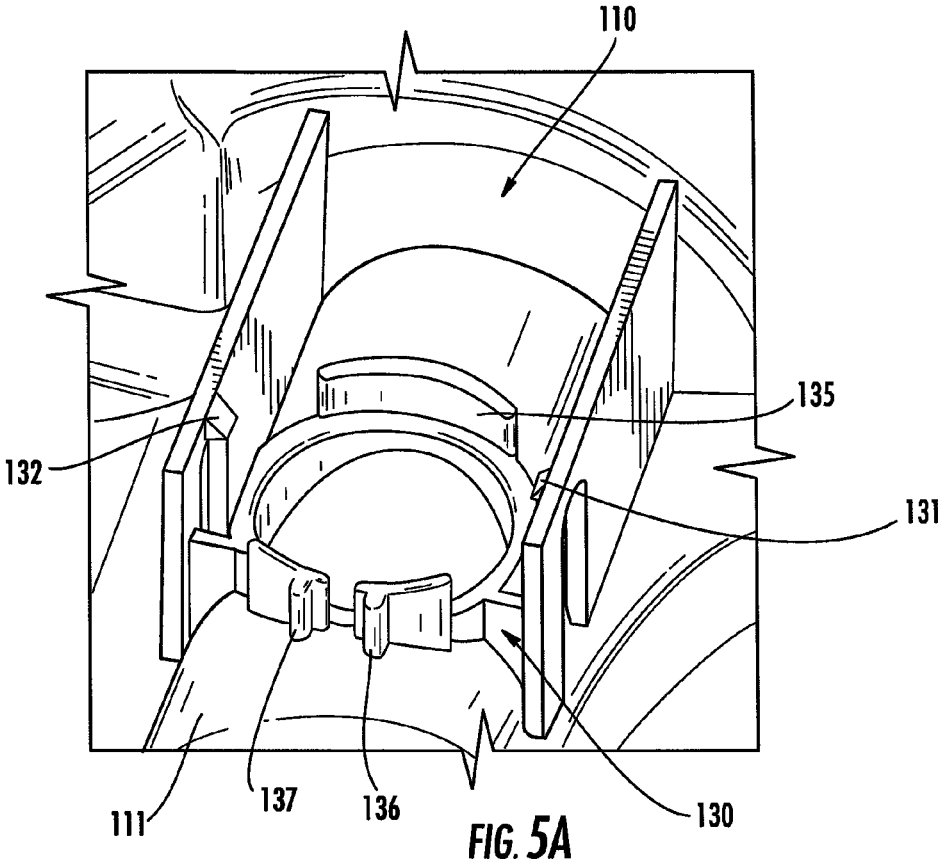
Figure 5B:
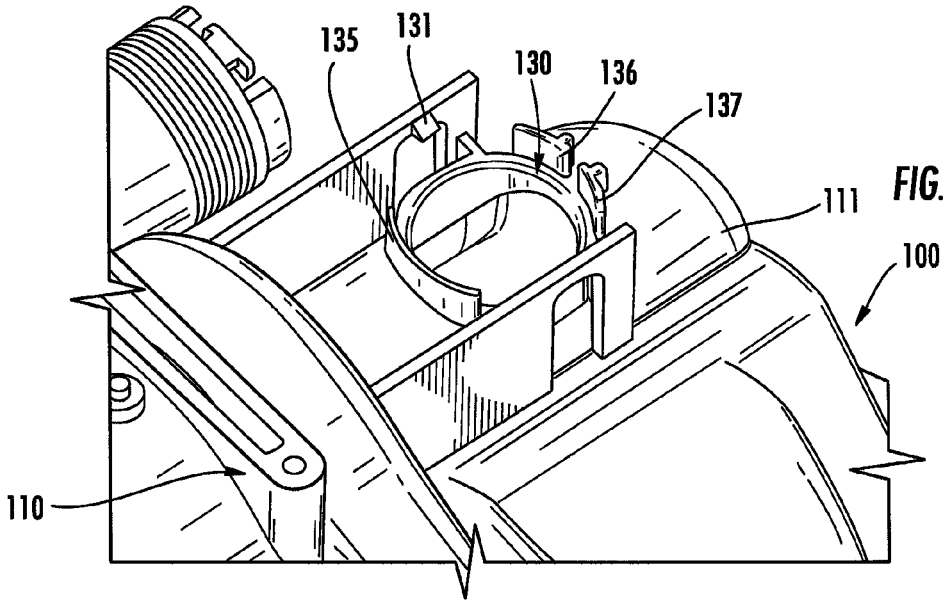
Figure 6:
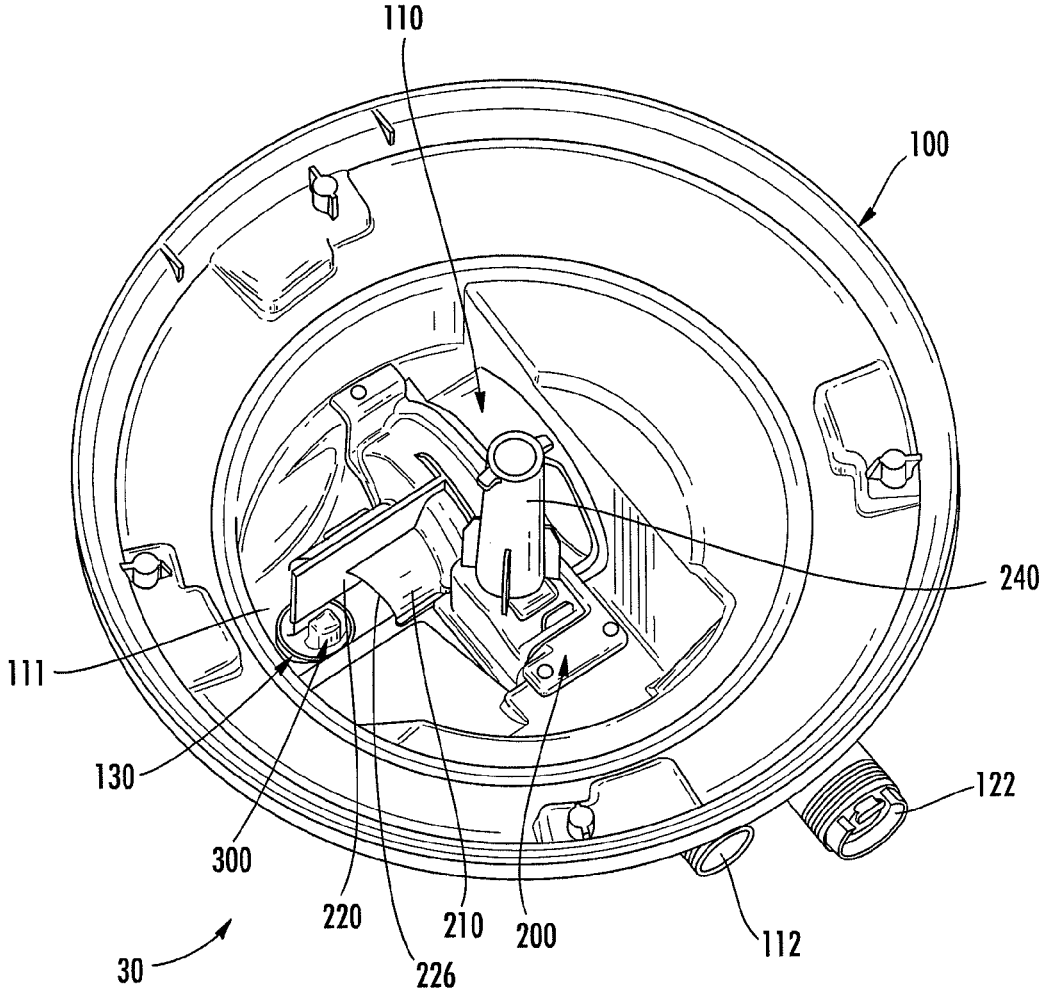
Figure 7:
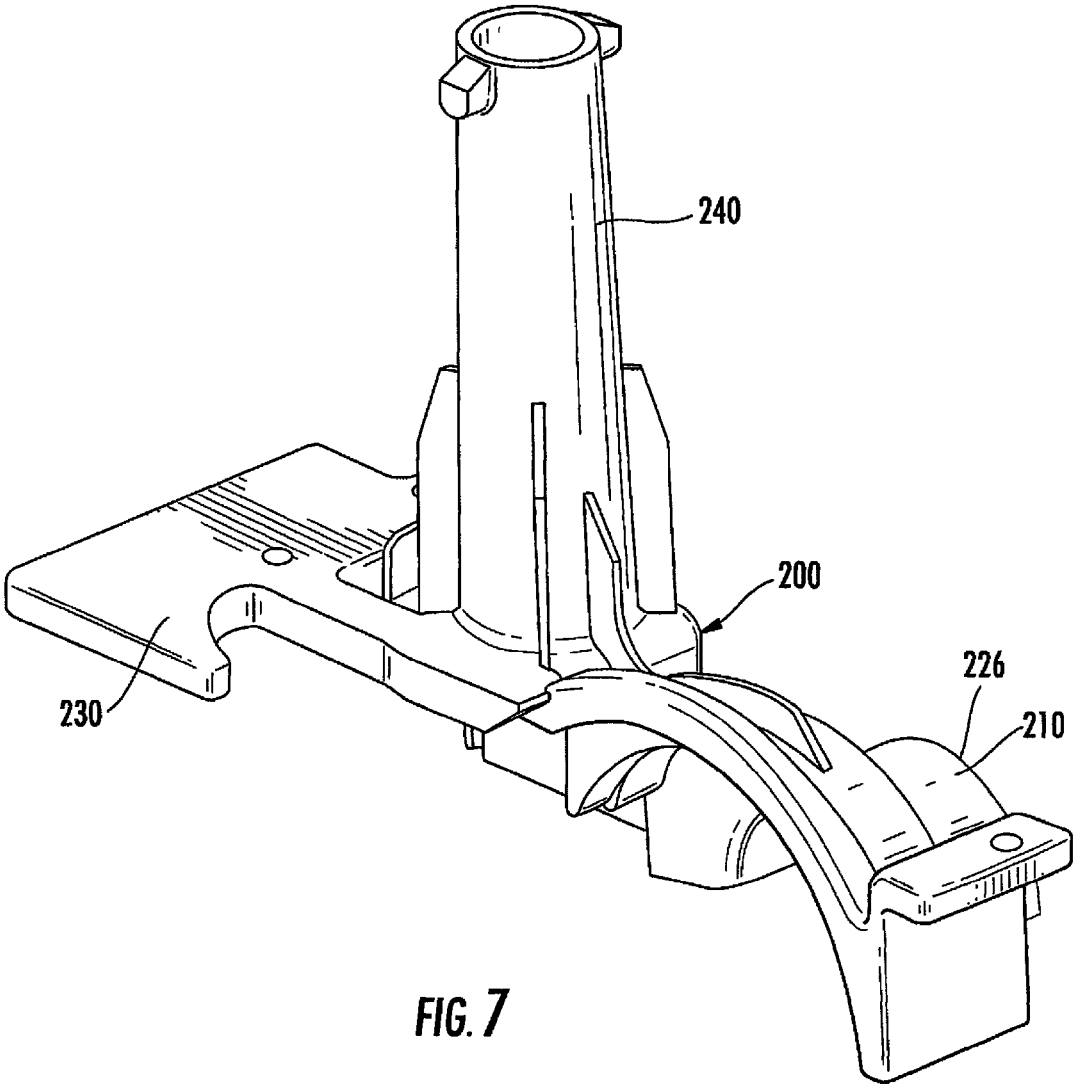
Figure 8A:
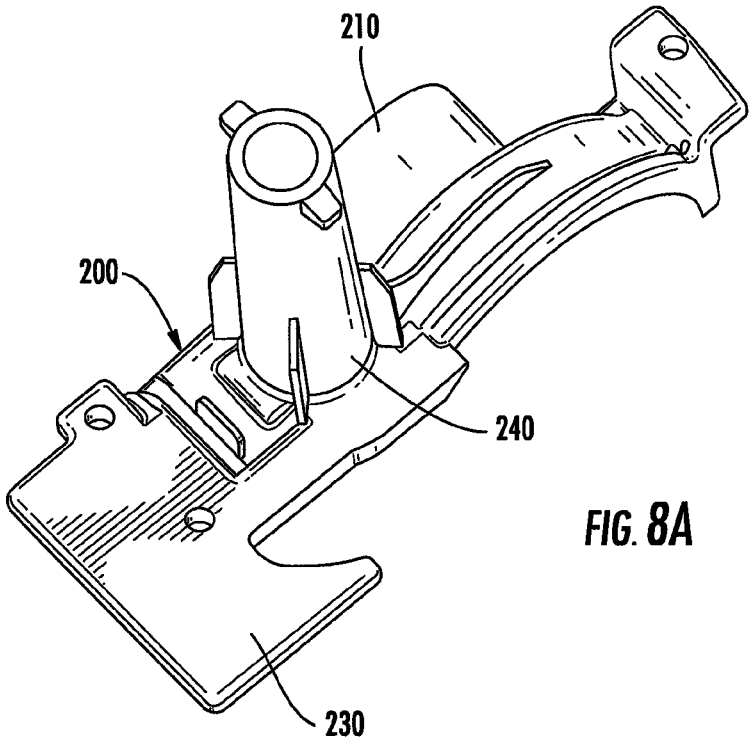
Figure 8B:
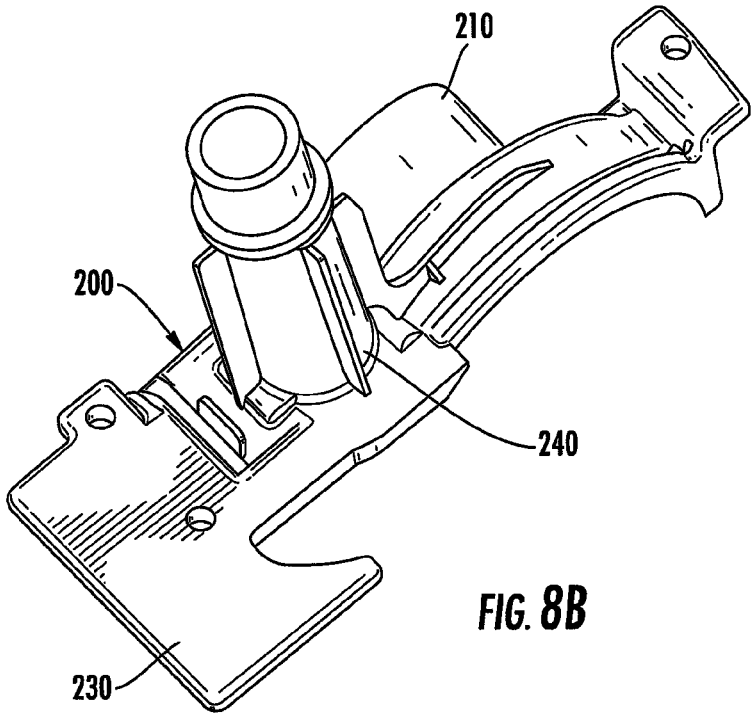
Figure 9:
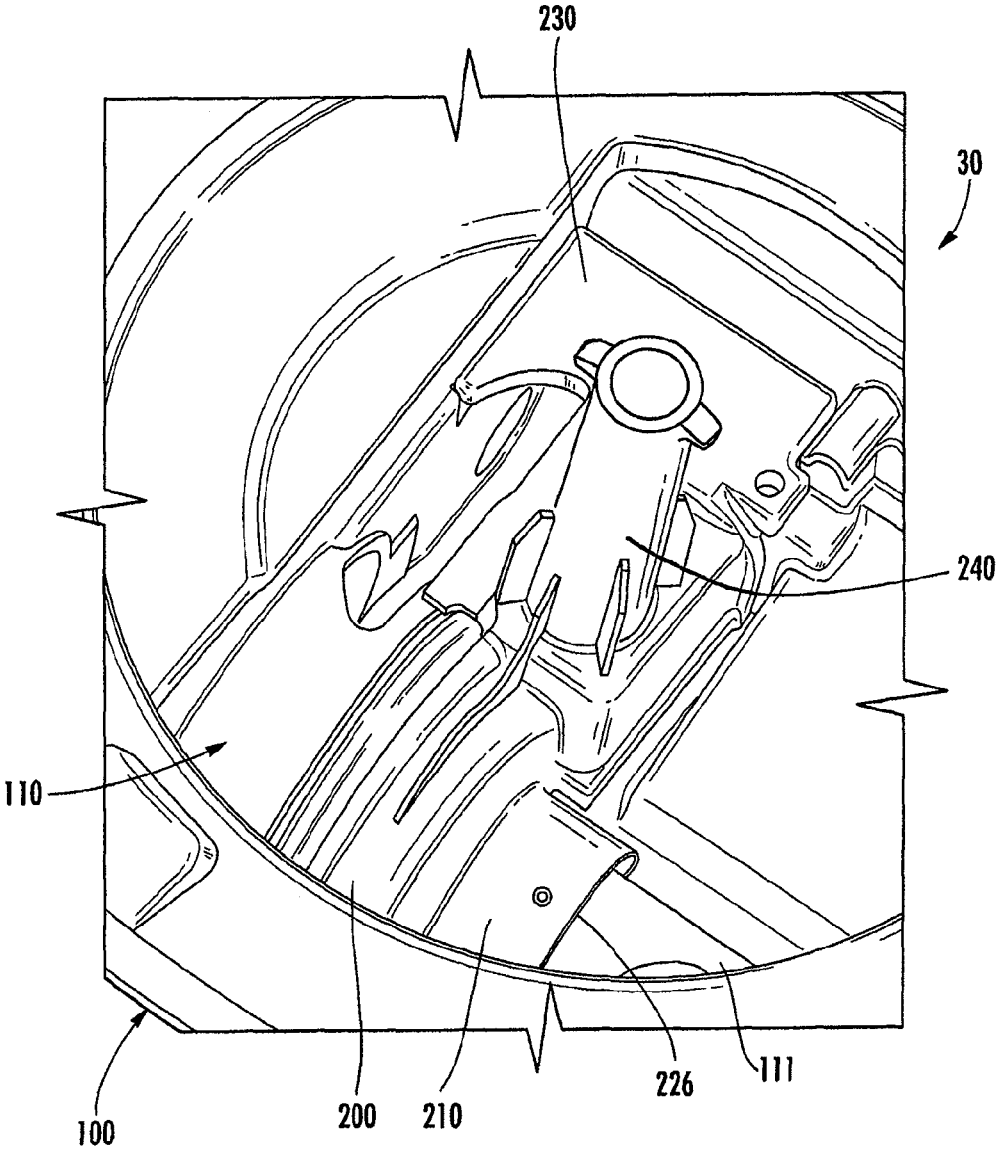

Having thus described various embodiments of the invention in general terms, reference will now be made to accompanying drawings, which are not necessarily drawn to scale, and wherein:

FIG. 1 is a fragmentary perspective view of a dishwasher capable of implementing various embodiments of the present disclosure, wherein a sump assembly, according to one embodiment of the present disclosure is disposed about a lower end of a tub member of the dishwasher;

FIGS. 2A-2B are perspective bottom views of a sump member according to one embodiment of the present disclosure, wherein the sump member defines a circulation pump volute receptacle and a drain pump volute receptacle, and wherein the horizontal axes of the respective volute receptacles are perpendicularly disposed;

FIGS. 3A-3B are perspective top views of the sump member of FIGS. 2A and 2B;

FIG. 4A is a perspective bottom view of a sump member according to one embodiment of the present disclosure, wherein the sump member defines a circulation pump volute receptacle and a drain pump volute receptacle, and wherein the horizontal axes of the respective volute receptacles are disposed in parallel;

FIG. 4B is a bottom view of the sump member of FIG. 4A, wherein a drain pump volute receptacle is adapted to receive washing fluid directly from the circulation pump volute receptacle;

FIGS. 5A-5B are magnified perspective views of a sump member defining a sensor receptacle, according to one embodiment of the present disclosure;

FIG. 6 is a perspective view of a sump assembly, according to one embodiment of the present disclosure, showing a volute receptacle cover interacting with the circulation pump volute receptacle;

FIG. 7 is a perspective view of a volute receptacle cover, according to one embodiment of the present disclosure;

FIGS. 8A-8B are perspective views of various volute receptacle covers, according to various embodiments of the present disclosure; and FIG. 9 is a magnified perspective view of a sump assembly, according to one embodiment of the present disclosure, wherein a volute receptacle cover and a sump member interact to create a repository for a washing fluid.

DETAILED DESCRIPTION OF THE EMBODIMENTS OF THE INVENTION

The present disclosure now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIG. 1 illustrates a dishwasher 10 in accordance with one embodiment of the invention. The dishwasher 10 may include a tub 12 for receiving dishware or other items to be washed therein. The tub 12 may generally comprise a lower end (a portion of which is formed by, for example, bottom wall 14) and a plurality of side walls 16, 18, 20 extending upwardly from the outer edge of the bottom wall 14. In this manner, the tub portion 12 may define a forward access opening. The tub 12 may further include a door assembly (not shown) pivotably engaged with the tub 12 about the lower end thereof so as to selectively permit access to the interior of the tub 12 through the forward access opening. A sump assembly 30 may be disposed about the lower end of the tub 12 for receiving a washing fluid from a house source, from which the washing fluid may then be circulated by a circulation pump assembly (not shown) through a plurality of spray arms, such as, for example, a lower spray arm 26 or an upper spray arm (not shown), or other water-distribution provisions of the dishwasher 10, for removing soils from the dishware therein. After removing the soils and other debris, the washing fluid may be directed through a series of straining/filtering mechanisms, such as, for example, coarse filter/strainer 22, prior to being re-circulated through the hydraulic (fluid circulation) system of the dishwasher 10.

According to embodiments of the present invention, the sump assembly 30 may comprise an integrally-formed sump member 100, as illustrated in FIGS. 2A-6. In such embodiments, the integrally-formed sump member 100 may be created, for example, through a molding process, a casting process, a forming process, or any other suitable manufacturing process. Such a sump member 100 may be comprised of a variety of different polymers and/or composite materials. For example, the sump member 100 may be integrally formed as a single component or otherwise integral structure in a molding or other suitable process using materials that may include, but are not limited to, polymeric materials, such as talc-filled polypropylene, and composite materials, such as a molded polymer panel or a fiberglass panel. That is, the sump member 100 may be integrally formed, using heat, pressure, adhesive materials, and/or other composite material processing steps that will be appreciated by one skilled in the art such that the sump member 100 may be provided in substantially one piece (i.e., as a "single-piece" component). As shown generally in FIGS. 2A-6, the sump member 100 may comprise one or more integrally-molded mounting members or component mounting structures configured to receive and/or have secured thereto at least one or a variety of operative components. For example, the sump member 100 may include integrally-formed mounting provisions for receiving a turbidity sensor 300 (see FIG. 6) and securing the same to the sump member 100.

Furthermore, as illustrated in FIGS. 2A, 2B, and 4, the sump member 100 may include a plurality of ribs 102 formed on the bottom portion of the sump member 100 with respect to the tub 12, wherein the ribs 102 extend outwardly toward the periphery of the sump member 100 so as to reinforce the sump member 100 and provide rigidity and structural integrity thereto. In some instances, adjacent ribs 102 may be substantially parallel with respect to one another.

In accordance with embodiments of the present invention, the integrally-formed sump member 100 may define a circulation pump volute receptacle 110 and a drain pump volute receptacle 120. As shown in FIGS. 2A-4, the circulation pump volute receptacle 110 defined by the integrally-formed sump member 100 may be adapted to receive a circulation pump and motor assembly (not shown). The circulation pump and motor assembly cooperates with the circulation pump volute receptacle 110 to form a portion of the overall dishwasher hydraulic system configured to circulate (or re-circulate) the washing fluid from the sump assembly to the spray arms or other water-distribution provisions, and over the dishware within the dishwasher, to provide the necessary washing and rinsing functions. Further, the circulation pump volute receptacle 110 may include and/or define a circulation pump washing fluid inlet 111 for receiving the washing fluid from the house supply and/or the tub 12 of the dishwasher 10. In some instances, the circulation pump washing fluid inlet 111 may be disposed about the lowest portion of the integrally-formed sump member 100. Further, in some instances, the circulation pump volute receptacle 110 may comprise and/or define a circulation pump washing fluid outlet 112 for supplying the washing fluid from the integrally-formed sump member 100 to the spray arms or other water-distribution provisions in the tub 12 of the dishwasher 10 for washing the dishware disposed within the tub 12. In some instances, the circulation pump washing fluid outlet 112 may include a threaded end 114 for connecting the circulation pump washing fluid outlet 112 to the components of the hydraulic system within the tub 12.

With continuing reference to FIGS. 2A-4, the integrally-formed sump member 100 may define a drain pump volute receptacle 120 adapted to receive a drain pump and motor assembly (not shown). The drain pump and motor assembly cooperates with the drain pump volute receptacle 120 to form a portion of the overall dishwasher hydraulic system configured to drain the washing fluid from the sump assembly 30 and to direct the washing fluid out of the dishwasher 10 and into the house drain. In some instances, the drain pump volute receptacle 120 may have and/or define a drain pump washing fluid inlet 121 which is integrally-formed and in direct communication with the circulation pump volute receptacle 110. Accordingly, the drain pump volute receptacle 120 may receive washing fluid via the drain pump washing fluid inlet 121 directly from the circulation pump volute receptacle 110, such that the washing fluid may be removed from the integrally-formed sump member 100 by the drain pump and motor assembly. In this manner, the drain pump and motor assembly may be directly mounted to the sump member 100 via the drain pump volute receptacle 120, which eliminates the need for a hose member to connect the drain pump assembly to the circulation pump assembly, thus reducing entrance losses, reducing or eliminating potential leakage points, and improving draining performance. In some instances, the drain pump volute receptacle 120 may include and/or define a drain pump washing fluid outlet 122 extending from the drain pump volute receptacle 120 for removing therethrough the washing fluid from the integrally-formed sump member 100 and, accordingly, from the dishwasher 10. The drain pump washing fluid outlet 122 may include a threaded end 124 for connecting the drain pump washing fluid outlet 122 to, for example, a hose member (not shown) in communication with the house drain.

In embodiments of the present invention, the circulation pump volute receptacle 110 may be configured to receive the circulation pump and motor assembly along a circulation pump axis 119 defined thereby. In addition, the drain pump volute receptacle 120 may also be configured to receive the drain pump and motor assembly along a drain pump axis 129 defined thereby. In such instances, each axis 119, 129 may correspond, for example, to the orientation of the shaft of respective motor used to rotate the associated pump (i.e., impeller). In one instance, the circulation pump volute receptacle 110 and the drain pump volute receptacle 120 may each be vertically disposed with respect to the integrally-formed sump member 100 (i.e., such that the respective axes 119, 129 extend substantially horizontally). In some embodiments, as shown in FIG. 2B, the circulation pump volute receptacle 110 and a drain pump volute receptacle 120 may be arranged such that the circulation pump axis 119 and the drain pump axis 129 intersect, for example, in a substantially perpendicular orientation (i.e., the volute receptacles 110, 120 are integrated into the sump member 100 such that the respective axes 119, 129 extend horizontally at ninety degrees to each other). In other embodiments, as shown in FIGS. 4A and 4B, the circulation pump volute receptacle 110 and a drain pump volute receptacle 120 may be arranged such that the circulation pump axis 119 and the drain pump axis 129 are aligned so as to be substantially parallel with respect to each other.

As shown in FIGS. 3A and 3B, the integrally-formed sump member 100 may comprise a plurality of transitional surfaces 151, 152, 153 defining an interior surface thereof for guiding or otherwise affecting the flow of the washing fluid within the sump. In some instances, the integrally-formed sump member 100 may include a substantially arcuate surface 154 projecting into a central portion defined by the sump member 100. The plurality of transitional surfaces 151, 152, 153 and the arcuate surface 154 may be configured in a manner which encourages the washing fluid being fed into the sump assembly 30 to move in a wall-bounded flow within the integrally-formed sump member 100. That is, the transitional surfaces 151, 152, 153 and the arcuate surface 154 promote a controlled flow pattern of the washing fluid within the integrally-formed sump member 100, which may reduce large eddy formations therein. In addition, the transitional surfaces 151, 152, 153 and the arcuate surface 154 may effectively reduce turbulent kinetic energy related to the flow of the washing fluid within the sump member 100, which, in turn, can reduce small pressure perturbations or sound waves affecting flow of the washing fluid within the sump assembly 30. Accordingly, the transitional surfaces 151, 152, 153 and/or the arcuate surface 154 may allow for a quieter operation of the dishwasher 10 by "smoothing" the flow of the washing fluid within the sump member 100. The transitional surfaces 151, 152, 153 and the arcuate surface 154 may also decrease the formation of secondary vortexes and rapid bubbles to facilitate the washing fluid arriving at the circulation pump washing fluid inlet 111 in a more uniform flow. In this regard, the transitional surfaces 151, 152, 153 and/or the arcuate surface 154 may be configured to direct flow along the smoothest path to the circulation pump washing fluid inlet 111 so as to avoid flow conflict by providing a substantially uniform flow direction, and to utilize a centrifugal force for separating the washing fluid from any washing fluid vapor prior to the washing fluid entering the circulation pump washing fluid inlet 111.

In some embodiments, the integrally-formed sump member 100 may define a sensor receptacle 130 for receiving a turbidity sensor 300 (FIG. 6) for monitoring the turbidity of the washing fluid within the sump assembly 30, as illustrated in FIGS. 5A and 5B. In some instances, the sensor receptacle 130 may be defined by the circulation pump washing fluid inlet 111 directing the washing fluid within the sump member 100 to the circulation pump volute receptacle 110. In other instances, the sensor receptacle 130 may be disposed about the circulation pump washing fluid inlet 111. In any instance, the circulation pump washing fluid inlet 111 may be disposed about and/or proximate to the lowest portion (i.e., the lowest vertical elevation) of the integrally-formed sump member 100 and, thus, the sensor receptacle 130 may also be disposed about and/or proximate thereto. In this manner, the turbidity sensor 300 may be positioned to interact with and measure the washing fluid when the washing fluid is likely the most contaminated with particulates and other soils.

Furthermore, the sensor receptacle 130 may be adapted to receive the turbidity sensor 300 in an interference or snap fit therewith. For example, as illustrated in FIGS. 5A and 5B, the sensor receptacle 130 may comprise a plurality of sensor stops 131, 132 configured to engage the turbidity sensor 300 in an interference/snap fit. Further, the sensor receptacle 130 may comprise a plurality of sensor guide members 135, 136, 137, each of which extend vertically and/or substantially parallel to an axis defined by the sensor receptacle 130, for guiding the turbidity sensor 300 into an aligned position with respect to the sensor receptacle axis such that the turbidity sensor 300 is received by the sensor receptacle 130 in the proper orientation. In some instances, a seal/gasket member (not shown) may be disposed between the turbidity sensor 300 and the sensor receptacle 130 so as to seal the engagement therebetween and prevent any washing fluid from escaping the sump member 100 via the sensor receptacle 130. Such a seal/gasket member may comprise, for example, an o-ring or other suitable configuration of a sealing member. Accordingly, the labor to assemble the sump assembly may be reduced compared to traditional sensor receptacles that require screws or other fasteners to secure the turbidity sensor 300 to the sump assembly 30. Further, since the sensor stops 131, 132 and sensor guide members 135, 136, 137 are configured to engage the turbidity sensor 300 in a particular manner (i.e., the sensor stops 131, 132 form the interference/snap fit with the turbidity sensor 300 only if the turbidity sensor is installed in a particular manner), such a configuration as disclosed herein may provide a more uniform engagement/seal of the seal/gasket member between the turbidity sensor 300 and the sensor receptacle 130, as compared to, for instance, a configuration in which the turbidity sensor 300 is secured by individual fasteners to the sensor receptacle 130.

As shown in FIG. 6, the sump assembly 30 may also include a volute receptacle cover 200 configured to correspondingly mate with the circulation pump volute receptacle 110 about the interior of the sump member 100 to cover a circulation pump impeller (not shown) associated with the circulation pump and motor assembly. That is, the circulation pump volute receptacle 110 defined by the integrally-formed sump member 100 may only include a semi-circular flange capable of partially surrounding the pump impeller (due to, for example, molding limitations). As such, the separate volute receptacle cover 200 cooperates with the circulation pump volute receptacle 110 to complete the flange for receiving the impeller. The volute receptacle cover 200 may be secured, fastened, or otherwise operably engaged with the sump member 100 in any suitable manner. As illustrated in FIGS. 6 and 7, the volute receptacle cover 200 may comprise a volute receptacle cover entrance portion 210 at least partially covering the circulation pump washing fluid inlet 111 and cooperating therewith to define a washing fluid inlet. In some instances, the volute receptacle cover entrance portion 210 may be angled to force more of the draw created by the circulation pump impeller to come from the side of the circulation pump washing fluid inlet 111 receiving the most dishwashing fluid, thereby reducing the likelihood of drawing air into the circulation pump assembly. The volute receptacle cover entrance portion 210 may extend horizontally from the volute receptacle cover 200 along an orientation substantially parallel to circulation pump axis 119 (see FIG. 2B) so as to at least partially cover the circulation pump washing fluid inlet 111.

In addition, the volute receptacle cover 200 may comprise an inlet vane 220 (see, e.g., FIG. 6) cooperating with the volute receptacle cover entrance 210 to direct the flow of the dishwashing fluid into the circulation pump volute receptacle 110. The inlet vane 220 may be integrally-formed with the volute receptacle cover 200 and may be, in some instances, substantially planar. In addition, the inlet vane 220 may at least partially intersect the volute receptacle cover entrance portion 210. For example, the inlet vane 220 may vertically bisect the volute receptacle cover entrance portion 210 such that the inlet vane 220 exists in a vertical plane coinciding with a vertical axis perpendicular to the circulation pump axis 119 (see FIG. 2B). In some instances, the inlet vane 220 may extend past an end portion 226 of the volute receptacle cover entrance portion 210. As illustrated in FIG. 6, the inlet vane 220 may extend horizontally past the end portion 226 of the volute receptacle cover entrance portion 210 disposed furthest from the volute receptacle cover 200.

As illustrated in FIG. 7, the volute receptacle cover 200 may include a drain chamber cover 230 extending a substantially horizontal plane, which, in some instances, may coincide with the orientation in which the volute receptacle cover entrance portion 210 extends. The drain chamber cover 230 may be configured to interact with the circulation pump volute receptacle 110, as shown in FIG. 9, to create a repository for the washing fluid and, in some instances, to cooperate with the sump member 100 to cover at least a portion of the drain pump washing fluid inlet 121. Further, the volute receptacle cover 200 may include a volute receptacle cover washing fluid outlet 240. The volute receptacle cover washing fluid outlet 240 may be in communication with the circulation pump volute receptacle 110 and may have a supply washing fluid directed therethrough to the tub 12 of the dishwasher 10 via, for example, the lower wash arm 26. FIGS. 8A and 8B show various alternative embodiments of the volute receptacle cover 200 comprising a volute receptacle cover washing fluid outlet 240 configured to be in communication with various spray arm assemblies, such as, for example, the lower spray arm 26 (FIG. 1), and to deliver washing fluid thereto.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for the purposes of limitation.

That which is claimed:

1. A sump assembly for a dishwasher, the sump assembly comprising:

an integrally-formed sump member defining a circulation pump volute receptacle and a drain pump volute receptacle, the circulation pump volute receptacle being adapted to receive a circulation pump and motor assembly and the drain pump volute receptacle being adapted to receive a drain pump and motor assembly, each of the volute receptacles being further configured to receive the respective pump and motor assembly along a respective horizontal axis defined thereby, the drain pump volute receptacle having a washing fluid input integrally formed and positioned adjacent to and in direct contact with the circulation pump volute receptacle such that the washing fluid input of the drain pump volute receptacle is in direct fluid communication with the circulation pump volute receptacle for receiving the washing fluid therefrom.

2. A sump assembly according to claim 1, wherein the sump member further defines a sensor receptacle configured to receive a turbidity sensor in a snap fit therewith, the sensor receptacle being disposed proximate to a washing fluid input to the circulation pump volute receptacle.

3. A sump assembly according to claim 2, wherein the washing fluid input to the circulation pump volute receptacle is disposed proximate to the lowest portion of the sump member.

4. A sump assembly according to claim 2, wherein the sensor receptacle is defined by the washing fluid input to the circulation pump volute receptacle.

5. A sump assembly according to claim 1, wherein the horizontal axes of the respective volute receptacles are disposed in parallel and are non-coaxial to one another.

6. A sump assembly according to claim 1, wherein the horizontal axes of the respective volute receptacles are configured to intersect.

7. A sump assembly according to claim 1, wherein each of the circulation pump volute receptacle and the drain pump volute receptacle comprises an outlet having a longitudinal axis, each outlet integrally formed with a respective volute receptacle and disposed such that the longitudinal axes are non-coaxial to a horizontal axis of a respective volute receptacle.

8. A sump assembly according to claim 7, wherein the longitudinal axes of the outlets are disposed parallel and non-coaxial to one another.

9. A sump assembly according to claim 7, wherein the longitudinal axes of outlets are disposed perpendicular to the horizontal axes of the volute receptacles.

10. A sump assembly according to claim 1, wherein the volute receptacles are located adjacent to one another and are configured to receive a respective pump and motor assembly such that the respective pump and motor assemblies extend axially along a respective horizontal axis in the same direction so as to be positioned side-by-side.

11. A sump assembly according to claim 1, further comprising a volute receptacle cover configured to correspondingly mate with the circulation pump volute receptacle proximate to an interior of the sump member to cover a circulation pump impeller associated with the circulation pump motor assembly.

12. A sump assembly according to claim 11, wherein the volute receptacle cover comprises a volute receptacle cover entrance portion at least partially covering a circulation pump washing fluid inlet and cooperating therewith to define a washing fluid inlet.

13. A sump assembly according to claim 11, wherein the volute receptacle cover includes a drain chamber cover configured to cover at least a portion of the washing fluid input of the drain pump volute receptacle.

14. A sump assembly according to claim 11, wherein the volute receptacle cover includes a volute receptacle cover fluid outlet in fluid communication with the circulation pump volute receptacle.

15. A sump assembly according to claim 1, wherein the washing fluid input of the drain pump volute receptacle is positioned adjacent to and in direct contact with an outlet of the circulation pump volute receptacle.

16. A sump assembly according to claim 15, wherein the washing fluid input of the drain pump volute receptacle is positioned between the drain pump volute receptacle and the outlet of the circulation pump volute receptacle.

17. A sump assembly according to claim 1, wherein the sump member further comprises a plurality of transitional surfaces, each transitional surface defining an interior surface for guiding the flow of washing fluid within the sump member and configured to facilitate a controlled flow pattern therein.

18. A sump assembly according to claim 17, wherein one of the plurality of transitional surfaces comprises an arcuate surface projecting into the sump member.

19. A dishwasher, comprising:

a tub portion adapted to contain washing fluid circulated about dishware received therein; and a sump assembly disposed about a lower end of the tub portion for receiving the washing fluid therein, the sump assembly comprising:

an integrally-formed sump member defining a circulation pump volute receptacle and a drain pump volute receptacle, the circulation pump volute receptacle being adapted to receive a circulation pump and motor assembly and the drain pump volute receptacle being adapted to receive a drain pump and motor assembly, each of the volute receptacles being further configured to receive the respective pump and motor assembly along a respective horizontal axis defined thereby, the drain pump volute receptacle having a washing fluid input integrally formed and positioned adjacent to and in direct contact with the circulation pump volute receptacle such that the washing fluid input of the drain pump volute receptacle is in direct fluid communication with the circulation pump volute receptacle for receiving the washing fluid therefrom.

20. A dishwasher according to claim 19, wherein the sump member further defines a sensor receptacle configured to receive a turbidity sensor in a snap fit therewith, the sensor receptacle being disposed proximate to a washing fluid input to the circulation pump volute receptacle.

21. A dishwasher according to claim 20, wherein the washing fluid input to the circulation pump volute receptacle is disposed proximate to the lowest portion of the sump member.

22. A dishwasher according to claim 20, wherein the sensor receptacle is defined by the washing fluid input to the circulation pump volute receptacle.

23. A dishwasher according to claim 19, wherein the horizontal axes of the respective volute receptacles are disposed in parallel and are non-coaxial to one another.

24. A dishwasher according to claim 19, wherein the horizontal axes of the respective volute receptacles are configured to intersect.

25. A method of forming a sump assembly for a dishwasher, comprising:

integrally-forming a sump member defining a circulation pump volute receptacle and a drain pump volute receptacle, the circulation pump volute receptacle being adapted to receive a circulation pump and motor assembly and the drain pump volute receptacle being adapted to receive a drain pump and motor assembly, with each of the volute receptacles being further configured to receive the respective pump and motor assembly along a respective horizontal axis defined thereby, such that a washing fluid input to the drain pump volute receptacle is integrally formed and positioned adjacent to and in direct contact with the circulation pump volute receptacle such that the washing fluid input of the drain pump volute receptacle is in direct fluid communication with the circulation pump volute receptacle so as to receive the washing fluid therefrom.

26. A method according to claim 25, wherein integrally-forming a sump member further comprises integrally-forming a sump member such that the sump member defines a sensor receptacle configured to receive a turbidity sensor in a snap fit therewith, the sensor receptacle being disposed about a washing fluid input to the circulation pump volute receptacle.

27. A method according to claim 26, wherein integrally-forming a sump member further comprises integrally-forming a sump member such that the washing fluid input to the circulation pump volute receptacle is disposed proximate to the lowest portion of the sump member.

28. A method according to claim 26, wherein integrally-forming a sump member further comprises integrally-forming a sump member such that the sensor receptacle is defined by the washing fluid input to the circulation pump volute receptacle.

29. A method according to claim 25, wherein integrally-forming a sump member further comprises integrally-forming a sump member such that the horizontal axes of the respective volute receptacles are disposed in parallel.

30. A method according to claim 25, wherein integrally-forming a sump member further comprises integrally-forming a sump member such that the horizontal axes of the respective volute receptacles are configured to intersect.

* * * * *